United States Patent [19]

Zeitel

[11] Patent Number: 4,571,918

[45] Date of Patent: Feb. 25, 1986

[54] APPARATUS FOR FORMING CIGARETTE GROUPS

[75] Inventor: Joachim Zeitel, Hagen, Fed. Rep. of Germany

[73] Assignee: Maschinenfabrik Alfred Schmermund GmbH & Co., Gevelsberg, Fed. Rep. of Germany

[21] Appl. No.: 673,416

[22] Filed: Nov. 20, 1984

[30] Foreign Application Priority Data

Nov. 22, 1983 [DE] Fed. Rep. of Germany ..... 3342048

[51] Int. Cl.[4] ..... B65B 19/10

[52] U.S. Cl. ..... 53/149; 53/150; 53/151

[58] Field of Search ..... 53/148, 149, 150, 151, 53/537, 539, 236, 252

[56] References Cited

U.S. PATENT DOCUMENTS

| | | | |
|---|---|---|---|
| 3,435,940 | 4/1969 | Seragnoli | 53/150 X |
| 4,209,955 | 7/1980 | Seragnoli | 53/150 X |
| 4,306,648 | 12/1981 | Manservisi et al. | 53/149 X |
| 4,362,235 | 12/1982 | Erdmann | 53/149 X |
| 4,471,866 | 9/1984 | Erdmann et al. | 53/150 X |
| 4,528,801 | 7/1985 | Seragnoli et al. | 53/150 X |

*Primary Examiner*—Horace M. Culver

[57] ABSTRACT

Cigarettes are grouped into multi-layer blocks for packaging by the serial delivery of the plural cigarettes comprising the individual layers into cells of a conveying system from a magazine having an outlet for each layer. The magazine outlets are offset in the direction of movement of the cells and in a direction transverse thereto. A stationary retaining member, which extends into the cells through slots provided in the cells, contacts and thus holds the uppermost layer of cigarettes transferred from the magazine into the cells, the retaining member being provided with a step and a tongue-like extension at each magazine outlet downstream of the first outlet, the bottom of the stepped portion of the retaining member and the top of the tongue defining a cigarette layer receiving opening.

6 Claims, 2 Drawing Figures

APPARATUS FOR FORMING CIGARETTE GROUPS

BACKGROUND OF THE INVENTION (1) Field of the Invention

The present invention relates to the forming of loose articles into groups for packaging and particularly to the assembling of cigarettes into multi-layer "blocks" for subsequent insertion into a wrapper. More specifically, this invention is directed to apparatus for rapidly and reliably arranging comparatively fragile elongated articles, cigarettes for example, into multi-layer groups for packaging. Accordingly, the general objects of the present invention are to provide novel and improved methods and apparatus of such character.

(2) Description of the Prior Art

While not limited thereto in its utility, the present invention is particularly well-suited for use in the forming of groups, i.e., "blocks", of cigarettes. The blocks, after formation, are conveyed to a packaging station where they may be wrapped or otherwise caused to be inserted in a wrapper. Apparatus for forming cigarette blocks are well-known in the art. Examples of such prior art apparatus may be seen from British Patent No. 1,137,826, German Patent No. 2,030,165, Published German Patent application No. 3,305,771 and German Utility Model No. 8,212,396.

Apparatus for forming cigarettes or other similar comparatively fragile articles into blocks for subsequent packaging must satisfy a number of criteria. Firstly, and of the utmost importance, the apparatus must operate reliably. Secondly, the mode of operation of the apparatus must take into account the comparatively fragile nature of the product being handled and thus must not subject the product to substantial vibration or impacts. Thirdly, it is highly desirable that the apparatus be characterized by volumetric efficiency and particularly that it not take up an undue amount of factory floor space. Additionally, the apparatus should desirably be characterized by relatively modest cost. The available prior art devices have been deficient in that they have failed to meet one or more of these design and operational criteria.

Continuing to briefly discuss the prior art, apparatus of the type disclosed in British Patent No. 1,137,826 subjects the cigarettes to considerable vibration since they are moved in stepwise motion by a conveyor chain. Apparatus such as that disclosed in German Patent No. 2,030,165 is expensive and complex. The complexity, coupled with the fact that the mass which must be moved to form the layers of the cigarette block is quite large, results in diminished reliability. The apparatus of German application No. 3,305,771 is also characterized by a complex construction and thus by high manufacturing cost and reduced reliability. The apparatus of German Utility Model No. 8,212,396 is also of comparatively complex construction and, additionally, by a relatively long conveyor which diminishes the volumetric efficiency of the apparatus.

SUMMARY OF THE INVENTION

The present invention overcomes the above-briefly discussed and other deficiencies and disadvantages of the prior art by providing a novel and improved technique for forming elongated articles such as cigarettes into multi-layer groups wherein adjacent articles are in intimate but not damaging contact. The present invention also encompasses reliable and relatively uncomplicated apparatus for use in the practice of this novel technique.

Apparatus in accordance with the present invention includes a cellular conveyor, i.e., a conveyor which includes spacially displaced cells which are configured to receive and hold two or more layers each of which is comprised of plural cigarettes or other similar shaped articles. The conveyor moves, in stepwise fashion, relative to a magazine which has, in the direction of motion of the conveyor, outlets which are horizontally and vertically offset. The cigarettes or other articles are transferred from the magazine into the cells of the conveyor layer by layer by means of rams which push all of the cigarettes defining a single layer through associated magazine outlets and into a cell in a single stroke. The appartus further includes a stationary retaining member which extends into the cells, through slots provided therefor, to contact one side of and thus securely hold in position the cigarettes or other articles which have been injected into a cell. The retaining member is provided with tongue-like extensions of its article contacting edge which, in the vicinity of at least some of the magazine outlets, cooperate with a main body portion of the retaining member to define a receiving region for the layer of cigarettes or other articles to be transferred from the magazine. Thus, when the layer of cigarettes or other articles is pushed from the magazine into a conveyor cell the articles comprising the transferred layer may at least initially be guided along the smooth walls of a receiving region defined solely by the retaining member and one of the tongues extending therefrom. The retaining member of the present invention is also characterized by a contoured wall surface such that, during continued movement of the conveyor which causes withdrawal of the tongue of the retaining member from a cell, the just transferred layer of articles will be gently directed downwardly into contact with the next lower layer of articles.

To further briefly describe the present invention, and to distinguish it from the prior art, a continuous fixed retaining member accomplishes the guiding of the cigarettes or other articles thus eliminating the necessity of using transporter elements which are required to undergo a complex motion. The stationary retaining member of the present invention, in the region of the appropriate outlets of the magazine, is provided with tongues which extend over the width of the outlet in the conveying direction. These tongues are vertically positioned so that they prolong the retaining edge portion of the retaining member which precedes the tongue in the conveying direction. Accordingly, even in the outlet regions of the magazine, the layer or layers of cigarettes or other articles which have already been inserted in the cells of the conveyor are securely retained by the tongues while the tongues, together with the main portion of the retaining member, define receiving regions or pockets for the new layer to be transferred to the cells. The new layer, when pushed into the cell, thus will at least initially rest on a tongue and will be secured from above by the main portion of the retaining member. In the regions adjoining the ends of the tongues in the conveying direction, the dimensions of the retaining member are caused to gradually increase in the direction of the bottom of the cells to compensate for the "withdrawal" of the tongues. Accordingly, when a tongue has been completely withdrawn from a cell the uppermost layer of cigarettes or other articles positioned therein will be lightly contacted by the underside of the retaining member and thus will be securely held in position. This secure retention of the cigarettes or other articles minimizes the possibility of damage, particularly during the starting and stopping of the conveyor which occurs as each cell moves into registration with an outlet of the magazine.

BRIEF DESCRIPTION OF THE DRAWING

The present invention may be better understood and its numerous objects and advantages will become apparent to those skilled in the art by reference to the accompanying drawing wherein like reference numerals refer to like elements in the two Figures and in which.

DESCRIPTION OF THE DISCLOSED EMBODIMENT

Figure 1:
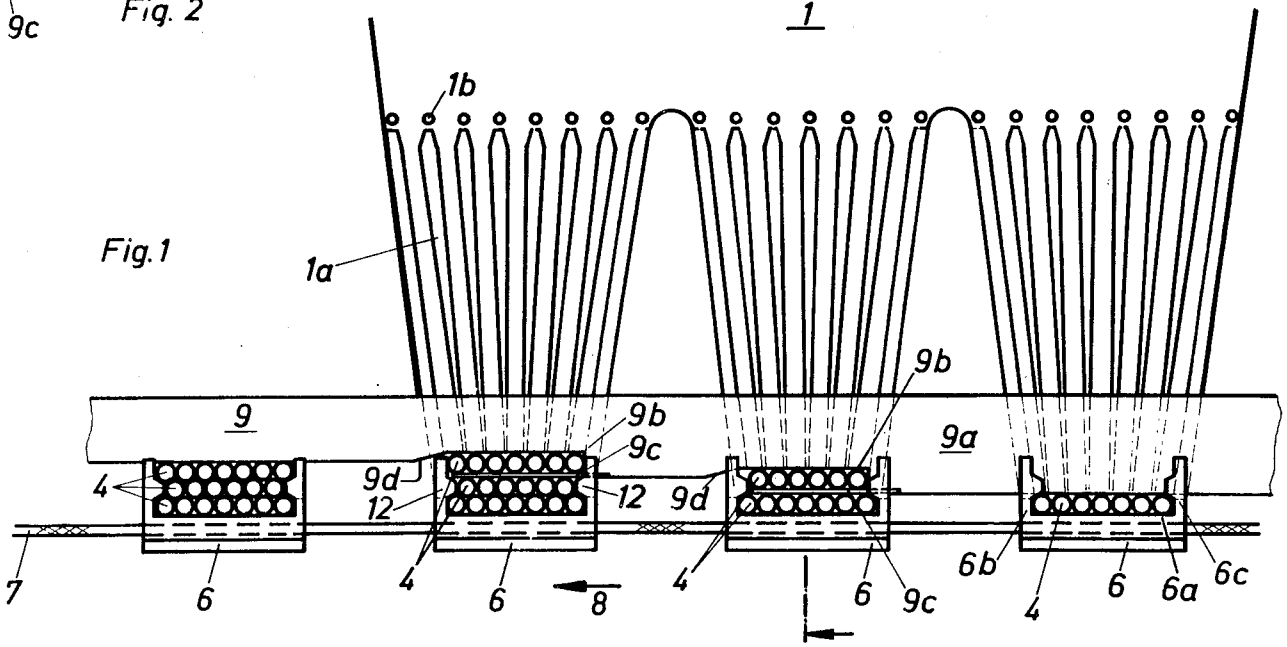
FIG. 1 is a schematic side elevation view of apparatus in accordance with the present invention.

With reference now to the drawing, apparatus in accordance with the present invention for forming cigarettes into blocks comprising three layers is depicted schematically. The cigarette blocks to be formed with the apparatus of the present invention will be wrapped to form a package having the customary twenty cigarettes and thus the two outer layers of the block will each comprise seven cigarettes while the middle layer will comprise six cigarettes. The apparatus comprises a feed hopper, indicated generally at 1, which is subdivided into a plurality of chutes or shafts by partition walls 1*a*. The feed hopper 1 is provided with vibrating rollers 1*b* which insure the feeding of the cigarettes down the shafts defined by the partitions 1*a* in the proper orientation. The shafts defined by the partition walls 1*a* lead to feed hopper outlets such as the outlet indicated generally at 2 in FIG. 2. The outlets 2 are in part defined by a "mouth piece" 3 which cooperates with the bottom of the feed hopper 1 to guide the cigarettes during transfer from the feed hopper into the cells 6 of a conveyor system. In the direction of motion (indicated by arrow 8) of a cellular conveyor system which includes the cells 6, the outlets 2 are off-set from one another in both the horizontal and vertical directions. The vertical offset of the outlets 2, in the conveying direction, is approximately the diameter of a cigarette. Motion is imparted to all of the cigarettes which are in registration with an outlet 2 of the feed hopper 1 by an associated ram 5. In the disclosed embodiment the rams 5 will contact the filter tip ends of the cigarettes and push the layer, comprising either six or seven cigarettes, from the feed hopper into a cell 6 of the cellular conveying system.

The conveying system comprises the cells 6 arranged on a conveyor belt 7. The cells 6 are spaced on belt 7 by a distance which corresponds to the spacing between the outlets 2 of feed conveyor 1. The conveyor belt 7 moves in stepwise fashion so as to serially place the cells 6 in registration with the outlets 2 of feed hopper 1. The stepwise motion of conveyor 7 will be synchronized with the operation of the rams 5 so that the rams will operate during the times the belt 7 is stationary.

A fixed retaining member 9 is positioned above and in alignment with the conveyor belt 7. The height of the retaining member 9, as may be clearly seen from FIG. 1, generally decreases in stepwise fashion in the conveying direction. Thus, in portion 9*a* thereof, the height of retaining member is such that the bottom of the retaining member is spaced from the bottom 6*a* of the cells 6 by approximately the diameter of a cigarette 4. Portion 9*a* of the retaining member extends to the upstream edge, in the direction of cell travel, of the second outlet of hopper 1. In the region of the second feed hopper discharge outlet the bottom of the retaining member will be spaced above the bottom 6*a* of a cell by a distance which will be slightly in excess of the height of two layers of cigarettes. Thus, at the first feed hopper outlet a receiving region for a layer of cigarettes is defined in the cell by the cell bottom 6*a* and the bottom of the portion 9*a* of the retaining member. The retaining member 9 has an upward step 9*b* at the second outlet of feed hopper 1. However, as may be seen from joint consideration of FIGS. 1 and 2, the portion 9*a* of the retaining member is continued at this second outlet by a tongue 9*c* which extends over the width of the second outlet. The bottom of the tongue 9*c* will be at the level of the bottom of portion 9*a* and thus the tongue will define a prolongation of portion 9*a* of the retaining member. The upper side of the tongue 9*c* and the underside of the retaining member at the level of the top of the stop 9*b* thus cooperate to form a receiving region which is registration with the second outlet 2 of feed hopper 1, the height of this receiving region being equal to approximately the diameter of a cigarette.

It is to be noted that the front and rear walls of the cells 6, respectively indicated at 6*b* and 6*c*, are provided with slots which allow unimpeded passage of the cells along the retaining member 9. In the disclosed embodiment of the invention these slots, indicated at 10, have a depth of approximately two cigarette diameters. It is also to be noted that these cell front and rear walls are provided with webs 12 which limit the width, in the conveying direction, of the cell at the level of the second layer of cigarettes. As noted above, in the disclosed embodiment of the invention the second or middle layer of the block of cigarettes to be formed will have one less cigarette than the two outer layers. The webs 12 may have a frusto-conical shape.

In operation, a first or lowermost cigarette layer will be pushed, by a ram 5, from feed hopper 1 into the gap between the bottom 6*a* of the cell and the underside of the retaining member 9 in portion 9*a*. The cell will then be conveyed, through the step drive of conveyor belt 7, into registration with a second outlet of the feed hopper. During transport to the feed hopper second outlet the first layer of cigarettes is retained in position by the bottom of portion 9*a* of retaining member 9. In the region of the second outlet, where the retaining member 9 is provided with the upwardly stop 9*b*, the function of retention of the first layer of cigarettes is taken over by the tongue 9*c*. When the cell has stopped at a point where it is in registration with the second outlet 2 of the feed hopper 1, a ram 5 will push a second layer of cigarettes into the receiving region defined by the upper side of the tongue 9*c* and the underside of portion 9*b* of the retaining member. During further transport, i.e., movement to a third feed hopper outlet, the tongue 9*c* will be withdrawn from the cell and the retention function will be performed by the underside of the retaining member 9. To compensate for the thickness of the tongue 9*c*, the retaining member is provided with a slope or bevel 9*d* in the conveying direction. Thus, as the cell moves forwardly and the uppermost layer of cigarettes moves beyond the end of the tongue 9*c* the cigarettes will contact the beveled surface 9*d* and will be gently urged downwardly into contact with the next lower layer of cigarettes. The bottom side of the retaining member 9 will retain the two layer, partially completed block of cigarettes during movement of the conveyor as the cell is transported into registration with the third outlet 2 of the feed hopper 1. The retaining member 9 is provided with another upward step 9*b* and its underside is continued by another tongue 9*c* in the region of the third hopper outlet. Accordingly, in the same manner as described above with respect to the transfer of the second layer into a cell, a third layer of cigarettes will be moved by a ram 5 into the receiving region defined between a tongue 9*c* and the underside of the retaining member 9. After the transfer action has been completed and the ram withdrawn, motion will again be imparted to belt 7, forward movement of the cell will cause withdrawal of the tongue therefrom and the downwardly beveled surface 9*d* will provide compensation for the withdrawal of the tongue. Thereafter, as the cell moves to the packaging station, the underside of the retaining member 9 defined at the end of the second beveled portion 9*d* thereof, will retain the three layers of cigarettes as shown.

Figure 2:
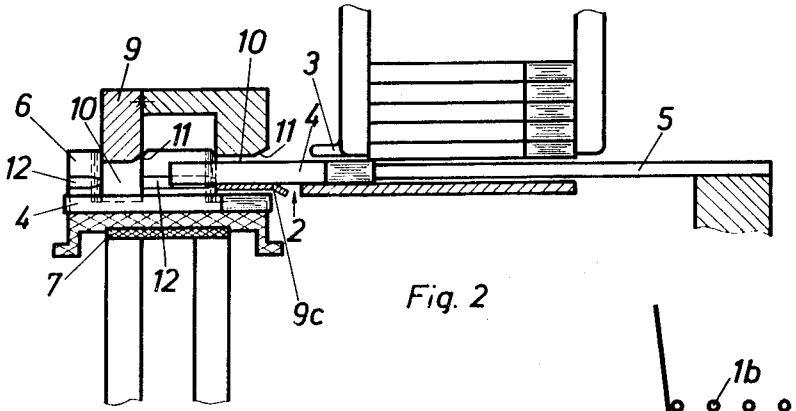
FIG. 2 is a cross-sectional front elevation view of the apparatus of FIG. 1.

Referring to FIG. 2, the retaining member 9 is provided, in the region of each of the feed hopper outlets 2, with bevels 11 which face in the direction from which the cigarettes are moved under the influence of a ram 5. Similarly, the tongue 9*c* has a leading edge portion which is deflected downwardly so as to cooperate with one of the bevels 11 to define a guide funnel. As may also be seen from FIG. 2, the retaining member 9 is designed, in the disclosed embodiment, as a double rail or strip. A tongue 9*c* may be provided on each strip and/or the tongue may bridge the gap between the strips.

In the implementation of the present invention, the distance between the cells 6 of the cellular conveying system is determined solely by the distance required between the individual outlets 2 of the feed hopper 1 and thus the spacing between the cells may be minimized.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for forming articles to be packaged into multi-layer groups, each group comprising a plurality of the articles, said apparatus comprising:

storage magazine means, said magazine means having a number of outlets commensurate with the number of layers which will define the group of articles to be formed, said magazine means outlets being offset from one another in first and second generally transverse directions, the offset in the second direction between adjacent outlets being equal approximately to the thickness of a layer of the articles, said outlets having a length commensurate with the number of articles which define the layer associated therewith;

conveyor means, said conveyor means including a plurality of receiving cells for the articles, said receiving cells being separated by a distance commensurate with the offset between said magazine outlets in said first direction, said conveying means moving said cells in a conveying direction in stepwise fashion whereby individual of said cells will be serially placed in registration with said magazine means outlets;

ram means for causing transfer of articles from said magazine means via said outlets into said conveying means cells; and stationary retaining means, said retaining means cooperating with said conveying means cells to define article receiving regions therein and to retain articles transferred into said cells in position in the cells during movement thereof, said retaining means including:

at least a first elongated member, said first member having an article retaining edge which extends generally in a direction parallel to the direction of movement of said conveying means cells, said retaining edge being contoured so as to permit the transfer of articles from said magazine means into said conveying means cells via said outlets; and at least first tongue-like extension of said retaining means, said first extension being in the region of a second magazine means outlet in the direction of motion of said cells, said first extension and said retaining edge cooperating to define a receiving region within a cell for a layer of articles transferred from said magazine means via said second outlet, further movement of the cell in the conveying direction resulting in withdrawal of the tongue from the cell.

2. The apparatus of claim 1 wherein said retaining means retaining edge is spaced from the bottom of a cell by a distance greater than the thickness of two layers of the articles in the region of the said second magazine means outlet and is provided with a beveled region immediately downstream, in the direction of the cell movement, from said second outlet, said beveled region terminating in a retaining edge portion which is spaced from the bottom of the cell by approximately the width of two rows of articles.

3. The apparatus of claim 1 wherein said retaining means includes a pair of parallel retaining strips, at least one of said strips having a said tongue extension at the retaining edge thereof, said conveyor means cells being provided with slots for receiving said retaining strips.

4. The apparatus of claim 2 wherein said retaining means includes a pair of parallel retaining strips, at least one of said strips having a said tongue extension at the retaining edge thereof, said conveyor means cells being provided with slots for receiving said retaining strips.

5. The apparatus of claim 1 wherein said magazine means has three outlets and wherein said retaining means has at least a pair of said tongue extensions respectively located in the regions of the said second and the third of said outlets.

6. The apparatus of claim 4 wherein said magazine means has three outlets and wherein said retaining means has at least a pair of said tongue extensions respectively located in the regions of the said second and the third of said outlets.

* * * * *